US012650060B2

(12) United States Patent
Jiang et al.

(10) Patent No.: US 12,650,060 B2
(45) Date of Patent: Jun. 9, 2026

(54) ENHANCED GAS EXTRACTION SYSTEM AND METHOD BASED ON DUAL-PULSATION AND ACID FRACTURING PERMEABILITY ENHANCEMENT FOR LOW-PERMEABILITY COAL SEAM

(71) Applicant: CHONGQING UNIVERSITY, Chongqing (CN)

(72) Inventors: Changbao Jiang, Chongqing (CN); Chen Jing, Chongqing (CN); Hao Li, Chongqing (CN); Jiayao Wu, Chongqing (CN); Lin Li, Chongqing (CN)

(73) Assignee: CHONGQING UNIVERSITY, Chongqing (CN)

( * ) Notice: Subject to any disclaimer, the term of this patent is extended or adjusted under 35 U.S.C. 154(b) by 0 days.

(21) Appl. No.: 19/356,105

(22) Filed: Oct. 11, 2025

(65) Prior Publication Data

US 2026/0110236 A1 Apr. 23, 2026

(30) Foreign Application Priority Data

Oct. 17, 2024 (CN) ..... 202411449583.6

(51) Int. Cl.
*E21B 43/00* (2006.01)
*E21B 43/27* (2006.01)

(52) U.S. Cl.
CPC ..... *E21B 43/006* (2013.01); *E21B 43/27* (2020.05)

(58) Field of Classification Search
CPC ..... E21B 43/006; E21B 43/27; C09K 8/34
USPC ..... 166/308.1
See application file for complete search history.

(56) References Cited

U.S. PATENT DOCUMENTS

| | | | | |
|---|---|---|---|---|
| 11,365,617 | B1 * | 6/2022 | Haustveit | E21B 43/267 |
| 2022/0243568 | A1 * | 8/2022 | AlTammar | E21B 43/12 |
| 2023/0012069 | A1 * | 1/2023 | Kruspe | E21B 12/02 |
| 2023/0083056 | A1 * | 3/2023 | Acuna Cespedes | E21B 49/0875 73/152.24 |

* cited by examiner

*Primary Examiner* — William D Hutton, Jr.
*Assistant Examiner* — Ashish K Varma
(74) *Attorney, Agent, or Firm* — HOWARD M COHN and Associates, LLC

(57) ABSTRACT

The invention discloses an enhanced gas extraction system based on dual-pulsation and acid fracturing permeability enhancement for a low-permeability coal seam, including an overpressure protection mechanism, a fracturing liquid delivery line, a gas extraction line, a mixing tank, a pressure control and monitoring mechanism and a frequency adjustment and monitoring mechanism. The invention further discloses an enhanced gas extraction method based on dual-pulsation and acid fracturing permeability enhancement for a low-permeability coal seam. The invention has the advantages of enhancing the connectivity between fracture-pore structures in coal, improving the permeability enhancement effect on a coal seam, and improving the gas extraction efficiency of the coal seam.

7 Claims, 2 Drawing Sheets

ENHANCED GAS EXTRACTION SYSTEM AND METHOD BASED ON DUAL-PULSATION AND ACID FRACTURING PERMEABILITY ENHANCEMENT FOR LOW-PERMEABILITY COAL SEAM

BACKGROUND OF THE INVENTION

1. Technical Field

The invention belongs to the technical field of permeability enhancement-based extraction of low-permeability coal seams, and particularly relates to an enhanced gas extraction system and method based on dual-pulsation and acid fracturing permeability enhancement for a low-permeability coal seam.

2. Description of Related Art

Under the influence of the geologic structure and geologic metamorphism, coal seams show the characteristics of "three highs and one low" (high crustal stress, high crustal temperature, high gas pressure and low permeability). It has now been ascertained that coal seams with the permeability less than 1 mD account for 72% of all coal seams, and the development of micropores in the coal seams and minerals filled in some pores and fractures lead to poor connectivity between pores and fractures. Moreover, with the continuous extension of the coal mining depth, the characteristics of high crustal stress and low permeability of coal seams become more obvious, leading to a gas extraction effect that cannot satisfy design requirements.

Efficient gas extraction is of great importance for safety production of mines, and existing methods for reforming coal seams include hydrofracturing, acid fracturing, etc. The hydrofracturing technique, when applied on the site, has the following problems: under the influence of properties such as large water molecules and large viscosity, fractures generated by hydrofracturing often propagate in a direction parallel to the maximum principal stress, so merely tensile cracks are formed, and a complex fracture network cannot be formed; in addition, it is difficult to change the situation that pores and fractures in coal seams are filled with minerals by using the hydrofracturing technique only. Acid fracturing can effectively dissolve mineral filling structures in pores and fractures, but the fracture propagation direction is seriously affected by the crustal stress. FIG. 1 illustrates a distribution diagram of "three regions" of fractures around a borehole before fracturing, which are respectively a crushed region a, a fracture region b and a primary fracture region c. It may be seen, from FIG. 1, that before fracturing, there is a large quantity of secondary fractures around the borehole before fracturing, and fracturing liquid flows through the crushed region a with the large quantity of secondary fractures first, then enters the fracture region b and finally reaches the primary fracture region c. These two methods have a poor gas diffusion and seepage capacity, leading to low permeability of coal seams and low gas extraction efficiency.

BRIEF SUMMARY OF THE INVENTION

The invention aims to provide an enhanced gas extraction system and method based on dual-pulsation and acid fracturing permeability enhancement for a low-permeability coal seam, which integrate dual-pulsation hydrofracturing and acid fracturing and make full use of their advantages to improve gas extraction efficiency and solve the problems that it is difficult to change the situation that pores and fractures in coal seams are filled with minerals by using the hydrofracturing technique only, hindering gas diffusion and seepage, and that the propagation direction of fractures generated by acid fracturing is seriously affected by the crustal stress, leading to low permeability of coal seams and low gas extraction efficiency.

For this purpose, the technical solution adopted by the invention is as follows: an enhanced gas extraction system based on dual-pulsation and acid fracturing permeability enhancement for a low-permeability coal seam includes an overpressure protection mechanism, a fracturing liquid delivery line with a liquid delivery end extending into a fracturing borehole, a gas extraction line with an extraction end extending into an observation borehole, a mixing tank containing fracturing liquid, a pressure control and monitoring mechanism for controlling a fracturing pressure and a frequency adjustment and monitoring mechanism for adjusting a pulsation frequency, wherein the pressure control and monitoring mechanism includes a first branch and a first pressure transmitter, a pressure data acquisition unit and a first solenoid valve which are connected in sequence along the first branch; the frequency adjustment and monitoring mechanism includes a second branch and a third pressure transmitter, a second solenoid valve and a frequency controller which are connected in sequence along the second branch; when the third pressure transmitter reaches a set pressure, a signal is transmitted, by means of the second solenoid valve, to the frequency controller for comparison with a design frequency; a head end of the first branch and a head end of the second branch are both connected to the fracturing liquid delivery line, and a tail end of the first branch and a tail end of the second branch are both connected to a pulsation fracturing pump; the fracturing liquid delivery line is connected to the mixing tank and the fracturing borehole and sequentially provided with the pulsation fracturing pump, a filter, a pressure gauge, a flowmeter, a throttling valve and a liquid-injection line valve in a delivery direction of the fracturing liquid; the gas extraction line includes a negative-pressure extraction tube connected to an output end of the fracturing liquid delivery line and the observation borehole, a fracturing borehole extraction valve is arranged at a joint between the negative-pressure extraction tube and the fracturing liquid delivery line, and an observation borehole extraction valve is arranged at a joint between the negative-pressure extraction tube and the observation borehole; the overpressure protection mechanism includes a third branch connected to the fracturing liquid delivery line and a second pressure transmitter and a third solenoid valve which are connected in sequence along the third branch; and when a pressure of the fracturing liquid delivery line is higher than a set pressure, the third solenoid valve is powered to be turned on to release the pressure for protection.

Preferably, high-pressure bushings are arranged on sections, connected to the fracturing liquid delivery line, of the first branch, the second branch and the third branch, and a high-pressure hose is arranged at a joint between the gas extraction line and the fracturing liquid delivery line. Because the pressure transmitters detect the pressure in a main line by means of thin tubes, the high-pressure bushings are arranged on the sections, connected to the fracturing liquid delivery line, of the first branch, the second branch and the third branch for further protection, the high-pressure hose is arranged at the weak joint between the gas extraction line and the fracturing liquid delivery line, and the design is reasonable.

Openings of the fracturing borehole and the observation borehole are sealed with high-pressure capsules, and a high-pressure sealing joint, corresponding to the liquid delivery end of the fracturing liquid delivery line, is arranged at the opening of the fracturing borehole, such that the leak-proofness of joints is guaranteed, and the design structure is reasonable.

The invention further provides an enhanced gas extraction method based on dual-pulsation and acid fracturing permeability enhancement for a low-permeability coal seam, including the following steps:

S1, carrying out detailed research on a target coal seam to complete sampling, then performing proximate analysis, elemental analysis and mineral content determination on a coal sample, and obtaining, according to mineral-acid solution reaction kinetics, fracturing liquid most suitable for the target coal seam;

S2, drilling a fracturing borehole and an observation borehole spaced apart from and parallel to the fracturing borehole in the target coal seam, and then mounting the enhanced gas extraction system based on dual-pulsation and acid fracturing permeability enhancement for a low-permeability coal seam;

S3, starting the pulsation fracturing pump to fill the fracturing borehole with prepared fracturing liquid by means of the fracturing liquid delivery line, controlling a fracturing pressure of the fracturing liquid to 4 Mpa-6 Mpa by means of the pressure control and monitoring mechanism and adjusting a pulsation frequency of the fracturing liquid to 30 Hz-40 Hz by means of the frequency adjustment and monitoring mechanism, performing continuous and periodic fracturing on the fracturing borehole, and when water flows out from the observation borehole, stopping delivering the fracturing liquid into the fracturing borehole;

S4, starting again the pulsation fracturing pump to fill the fracturing borehole with the fracturing liquid, controlling the fracturing pressure of the fracturing liquid to 2 Mpa-3 Mpa by means of the pressure control and monitoring mechanism and adjusting the pulsation frequency of the fracturing liquid to 15 Hz-20 Hz by means of the frequency adjustment and monitoring mechanism, performing continuous and periodical fracturing on the fracturing borehole, and when water flows out from the observation borehole, stopping delivering the fracturing liquid into the fracturing borehole; and S5, repeating S3-S4 five times, turning off the liquid-injection line valve, turning on the fracturing borehole extraction valve and the observation borehole extraction valve, and periodically sampling and detecting gas concentrations in the fracturing borehole and the observation borehole at intervals to generate data.

Preferably, in S1, an acid solution formula range corresponding to contents of main minerals in the coal sample under different conditions is solved by means of an interface reaction model to obtain the fracturing liquid most suitable for the target coal seam, wherein the acid solution formula range is solved according to the following reaction rate expression:

$$J = KC_s^m$$

where, J is a reaction rate, mol/(cm$^2$·s); $C_s$ is an acid concentration of a rock surface at a reaction time t, mol/L; m is the number of reactions; K is a reaction rate constant, mol/[cm2·s·(mol/mL)$^m$];

assume common logarithms are adopted at both sides of the formula, an acid-rock reaction kinetics calculation formula is determined:

$$lgJ = lgK + mlgC$$

lgJ and lgC are plotted, the reaction rate constant K and m are obtained by means of intercepts of straight lines, and then a reaction kinetics equation is obtained; according to the reaction kinetics equation, types and contents of fillings in the coal seam and properties of an acid solution, the acid solution formula range corresponding to the contents of the main different minerals in the coal sample is obtained;

a dissolving effect of acid fracturing liquid on the minerals in coal is based on a solid-liquid reaction, and acid solution formulas corresponding to the contents of the minerals in the coal sample under different conditions are solved by means of the following solid-liquid reaction kinetics model formula:

$$C = \frac{mt}{n + t}$$

where, C is a dissolution proportion, %; t is a reaction time, s; m is maximum dissolution of the acid solution on the minerals and reflects a dissolving capacity of the acid solution to the minerals, and n is a reaction time when half of the minerals are dissolved by the acid solution and reflects a dissolution rate of the acid solution to the minerals;

the contents of the minerals in the coal sample are quantitatively measured, and according to the acid solution formula range corresponding to the contents of the main different minerals in the coal sample, the optimal fracturing liquid is selected by comparing values of m and n in the kinetics equation for dissolving the minerals by the acid solution according to a selection criterion that the value of m is as great as possible and the value of n is as small as possible. The steps are reasonable.

Further preferably, in S2 and S3, when water flows out from the observation borehole, the fracturing liquid is stopped from being delivered into the fracturing borehole for 30-45 min, such that a sufficient time is provided for the fracturing liquid to dissolve minerals in pores and fractures.

Further preferably, the fracturing pressure and pulsation frequency in S3 are twice the fracturing pressure and pulsation frequency in S4, such that a relatively high pressure and frequency and a relatively low pressure and frequency are guaranteed for dual pulsation.

The invention has the following beneficial effects:

(1) Compared with the prior art that pores and fractures are filled with some minerals that hinder gas diffusion and seepage, this scheme combines dual-pulsation hydrofracturing and acid fracturing, cyclic dual pulsation is performed ingeniously by means of relatively high and lower pressures and relatively high and lower frequencies, fracturing liquid may quickly pass through a cracked region around the borehole under the action of a relatively "high pressure and frequency" to form a main fracture channel and secondary fractures, the fractures propagate continuously and communicate with each other, and the acid fracturing liquid may effectively corrode minerals and foreign matter between the fractures. On this basis, under the action of a relatively "low frequency and frequency", the fracturing liquid flows along the main fracture channel to continuously stimulate the secondary fractures to induce more micro-fractures to be generated, and at the same time, the acid fracturing liquid may effectively corrode minerals in pores, thus increasing the porosity of coal; by dual-pulsation fracturing, main fractures, secondary fractures and micro-fractures may be generated in a coal seam, and the fractures communicate with each other to form a complex fracture network, and at the same time, the acid fracturing liquid greatly enhances the connectivity between fracture-pore structures in the coal, thus increasing the specific surface area and the porosity of the coal. In addition, the coal seam will be damaged to some extent under the dissolving effect of the acid fracturing liquid, such that the compressive strength of the coal seam may be reduced to facilitate pulsation permeability enhancement of the coal seam and effectively reduce the risk of disasters such as rock bursts. Under the coupling effect of pulsation fracturing and acid fracturing, the permeability enhancement effect on the coal seam is greatly improved, and the gas extraction efficiency is greatly improved.

(2) The overpressure protection mechanism is designed, and when the pressure in a high-pressure line is higher than a set pressure, the third solenoid valve is turned on to release the pressure to fulfill the purpose of protection; the first pressure transmitter, as a control source of signal output and feedback of the high-pressure line, is connected to the pressure data acquisition unit; and the first solenoid valve is configured to adjust the pulsation fracturing pump. When the third pressure transmitter reaches a set pressure, a signal is transmitted, by means of the second solenoid valve, to the frequency controller for comparison with a design frequency, and the frequency is adjusted to the design frequency by means of the frequency controller, such that the structures are linked with each other, and the concept is novel.

To sum up, the invention has the advantages of realizing intercoupling between dual-pulsation hydrofracturing and acid fracturing, enhancing the connectivity between fracture-pore structures in coal, improving the permeability enhancement effect on a coal seam, improving the gas extraction efficiency of the coal seam, and making structures linked with each other.

DETAILED DESCRIPTION OF THE INVENTION

The invention is further described below in conjunction with embodiments and accompanying drawings.

Figure 1:
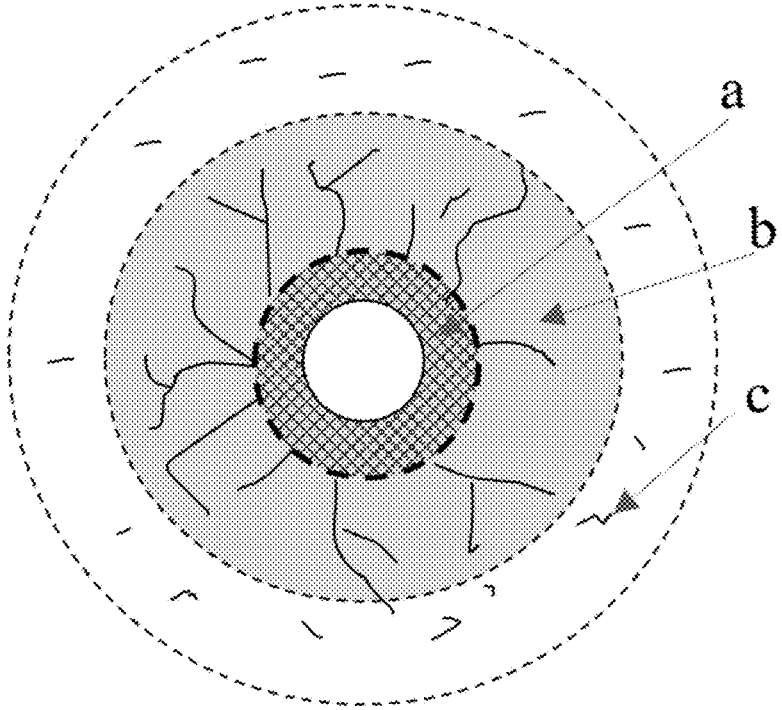
FIG. 1 Prior art
FIG. 1 is a distribution diagram of "three regions" of fractures around a borehole before fracturing.
Figure 2:
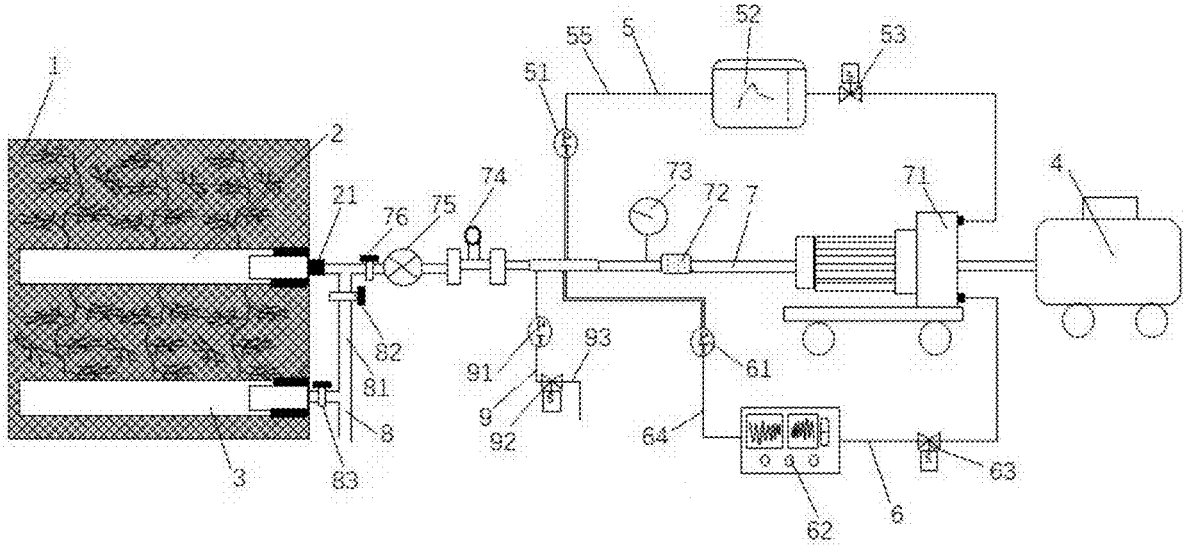
FIG. 2 is a schematic structural diagram of a system according to the invention.
Figure 3:
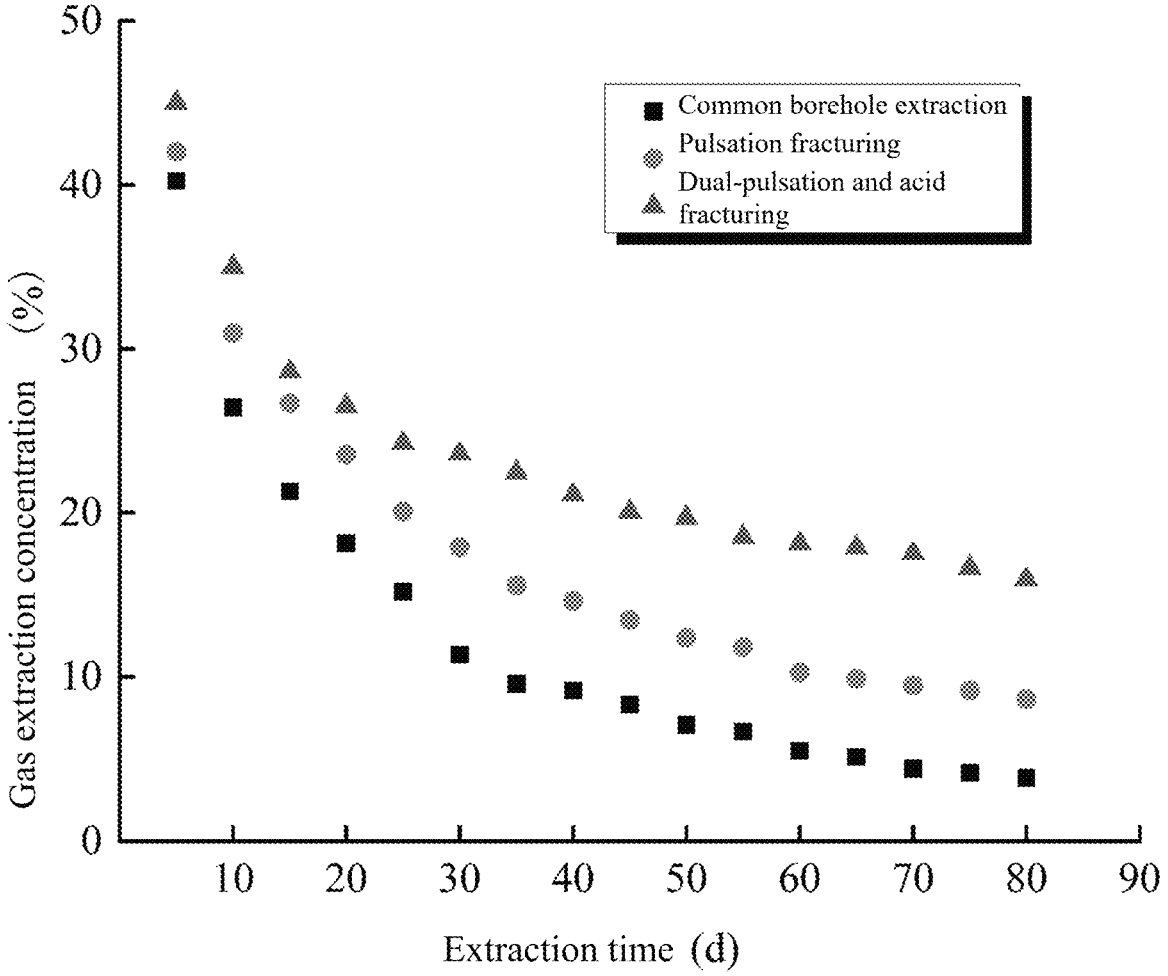
FIG. 3 is a comparison curve chart of gas extraction concentrations.

As shown in FIGS. 2-3, an enhanced gas extraction system based on dual-pulsation and acid fracturing permeability enhancement for a low-permeability coal seam is formed by an overpressure protection mechanism 9, a fracturing liquid delivery line 7 with a liquid delivery end extending into a fracturing borehole 2, a gas extraction line 8 with an extraction end extending into an observation borehole 3, a mixing tank 4 containing fracturing liquid, a pressure control and monitoring mechanism 5 for controlling a fracturing pressure, and a frequency adjustment and monitoring mechanism 6 for adjusting a pulsation frequency.

Openings of the fracturing borehole 2 and the observation borehole 3 are sealed with high-pressure capsules.

A high-pressure sealing joint 21, corresponding to the liquid delivery end of the fracturing liquid delivery line 7, is arranged at the opening of the fracturing borehole 2.

The pressure control and monitoring mechanism 5 is formed by a first branch 55 and a first pressure transmitter 51, a pressure data acquisition unit 52 and a first solenoid valve 53 which are connected in sequence along the first branch 55.

The frequency adjustment and monitoring mechanism 6 is formed by a second branch 64 and a third pressure transmitter 61, a second solenoid valve 62 and a frequency controller 63 which are connected in sequence along the second branch 64.

When the third pressure transmitter 61 reaches a set pressure, a signal is transmitted, by means of the second solenoid valve 62, to the frequency controller 63 for comparison with a design frequency.

A head end of the first branch 55 and a head end of the second branch 64 are both connected to the fracturing liquid delivery line 7, and a tail end of the first branch 55 and a tail end of the second branch 64 are both connected to a pulsation fracturing pump 71.

The fracturing liquid delivery line 7 is connected to the mixing tank 4 and the fracturing borehole 2 and sequentially provided with the pulsation fracturing pump 71, a filter 72, a pressure gauge 73, a flowmeter 74, a throttling valve 75 and a liquid-injection line valve 76 in a delivery direction of the fracturing liquid.

The gas extraction line 8 is formed by a negative-pressure extraction tube 81 connected to an output end of the fracturing liquid delivery line 7 and the observation borehole 3.

A high-pressure hose is preferably arranged at a joint between the gas extraction line 8 and the fracturing liquid delivery line 7.

A fracturing borehole extraction valve 82 is arranged at a joint between the negative-pressure extraction tube 81 and the fracturing liquid delivery line 7, and an observation borehole extraction valve 83 is arranged at a joint between the negative-pressure extraction tube 81 and the observation borehole 3.

The overpressure protection mechanism 9 is formed by a third branch 93 connected to the fracturing liquid delivery line 7 and a second pressure transmitter 91 and a third solenoid valve 92 which are connected in sequence along the third branch 93.

When the pressure of the fracturing liquid delivery line 7 is higher than a set pressure, the third solenoid valve 92 is powered to be turned on to release the pressure for protection.

High-pressure bushings are arranged on sections, connected to the fracturing liquid delivery line 7, of the first branch 55, the second branch 64 and the third branch 93.

An enhanced gas extraction method based on dual-pulsation and acid fracturing permeability enhancement for a low-permeability coal seam includes the following specific steps:

S1, detailed research is carried out on a target coal seam 1 to complete sampling, performing proximate analysis, elemental analysis and mineral content determination are performed on a coal sample, and fracturing liquid most suitable for the target coal seam 1 is obtained according to mineral-acid solution reaction kinetics.

In S1, an acid solution formula range corresponding to contents of main minerals in the coal sample under different conditions is solved by means of an interface reaction model to obtain the fracturing liquid most suitable for the target coal seam, wherein the acid solution formula range is solved according to the following reaction rate expression:

$$J = KC_s^m$$

where, J is a reaction rate, mol/(cm$^2$·s); $C_s$ is an acid concentration of a rock surface at a reaction time t, mol/L; m is the number of reactions; K is a reaction rate constant, mol/[cm2·s·(mol/mL)$^m$];

assume common logarithms are adopted at both sides of the formula, an acid-rock reaction kinetics calculation formula is determined:

$$lgJ = lgK + mlgC$$

lgJ and lgC are plotted, the reaction rate constant K and m are obtained by means of intercepts of straight lines, and then a reaction kinetics equation is obtained.

According to the reaction kinetics equation, types and contents of fillings in the coal seam and properties of an acid solution, the acid solution formula range corresponding to the contents of the main different minerals in the coal sample is obtained as shown in the following table:

| Minerals in sample | Content of montmorillonite, illite, kaolinite and quartz/% | Content of calcite, dolomite and pyrite/% | Concentration of acid solutions/% | | |
|---|---|---|---|---|---|
| | | | HCl | HF | $CH_3COOH$ |
| High-clay minerals, low-carbonate and low- sulfide minerals | >50 | <50 | 1~3 | 1~6 | 1~3 |
| Low-clay minerals, high-carbonate and high- sulfide minerals | <50 | >50 | 1~6 | 1~3 | 1~9 |

A dissolving effect of acid fracturing liquid on the minerals in coal is based on a solid-liquid reaction, and acid solution formulas corresponding to the contents of the minerals in the coal sample under different conditions are solved by means of the following solid-liquid reaction kinetics model formula:

$$C = \frac{mt}{n+t}$$

where, C is a dissolution proportion, %; t is a reaction time, s; m is maximum dissolution of an acid solution on the minerals and reflects a dissolving capacity of the acid solution to the minerals, and n is a reaction time when half of the minerals are dissolved by the acid solution and reflects a dissolution rate of the acid solution to the minerals. Mineral and acid solution reaction kinetics results are shown in the following table:

| | Acid solution proportion | | | | | | | | | | | | |
|---|---|---|---|---|---|---|---|---|---|---|---|---|---|
| | Kaolinite | | Illite | | Montmorillonite | | Quartz | | Calcite | | Dolomite | | ... |
| $S_1$ | $m_{1-1-1}$ | $n_{1-1-2}$ | $m_{1-2-1}$ | $n_{1-2-2}$ | $m_{1-3-1}$ | $n_{1-3-2}$ | $m_{1-4-1}$ | $n_{1-4-2}$ | $m_{1-5-1}$ | $n_{1-5-2}$ | $m_{1-6-1}$ | $n_{1-6-2}$ | |
| $S_2$ | $m_{2-1-1}$ | $n_{2-1-2}$ | $m_{2-2-1}$ | $n_{2-2-2}$ | $m_{2-3-1}$ | $n_{2-3-2}$ | $m_{2-4-1}$ | $n_{2-4-2}$ | $m_{2-5-1}$ | $n_{2-5-2}$ | $m_{2-6-1}$ | $n_{2-6-2}$ | |
| $S_3$ | $m_{3-1-1}$ | $n_{3-1-2}$ | $m_{3-2-1}$ | $n_{3-2-2}$ | $m_{3-3-1}$ | $n_{3-3-2}$ | $m_{3-4-1}$ | $n_{3-4-2}$ | $m_{3-5-1}$ | $n_{3-5-2}$ | $m_{3-6-1}$ | $n_{3-6-2}$ | |

The contents of the minerals in the coal sample are quantitatively measured, and according to the acid solution formula range corresponding to the contents of the main different minerals in the coal sample, the optimal fracturing liquid is obtained by comparing values of m and n in the kinetics equation for dissolving the minerals by the acid solution in S1-S3 according to a selection criterion that the value of m is as great as possible and the value of n is as small as possible.

S2, a fracturing borehole 2 and an observation borehole 3 spaced apart from and parallel to the fracturing borehole 2 are drilled in the target coal seam 1, and then the enhanced gas extraction system based on dual-pulsation and acid fracturing permeability enhancement for a low-permeability coal seam is mounted.

S3, the pulsation fracturing pump 71 is started to fill the fracturing borehole 2 with prepared fracturing liquid by means of the fracturing liquid delivery line 7, a fracturing pressure of the fracturing liquid is controlled to 4 Mpa-6 Mpa by means of the pressure control and monitoring mechanism 5, a pulsation frequency of the fracturing liquid is adjusted to 30 Hz-40 Hz by means of the frequency adjustment and monitoring mechanism 6, continuous and periodic fracturing is performed on the fracturing borehole 2, and when water flows out from the observation borehole 3, the fracturing liquid is stopped from being delivered into the fracturing borehole 2.

In S2 and S3, when water flows out from the observation borehole 3, the fracturing liquid is stopped from being delivered into the fracturing borehole 2 for 30-45 min.

The fracturing pressure and pulsation frequency in S3 are twice the fracturing pressure and pulsation frequency in S4.

S4, the pulsation fracturing pump 71 is started again to fill the fracturing borehole 2 with the fracturing liquid, the fracturing pressure of the fracturing liquid is controlled to 2 Mpa-3 Mpa by means of the pressure control and monitoring mechanism 5, the pulsation frequency of the fracturing liquid is adjusted to 15 Hz-20 Hz by means of the frequency adjustment and monitoring mechanism 6, continuous and periodical fracturing is performed on the fracturing borehole 2, and when water flows out from the observation borehole 3, the fracturing liquid is prevented from being delivered into the fracturing borehole 2.

S5, S3-S4 are repeated five times, the liquid-injection line valve 76 is turned off, the fracturing borehole extraction valve 82 and the observation borehole extraction valve 83 are turned on, and gas concentrations in the fracturing borehole 2 and the observation borehole 3 are periodically sampled and detected at intervals to generate data.

After comparison with the gas extraction concentration of common borehole extraction and the gas extraction concentration of pulsation fracturing, data are summarized in the following table:

| Gas extraction concentration (%) | | | |
|---|---|---|---|
| Time (day) | Common borehole extraction | Pulsation fracturing | Dual-pulsation and acid fracturing |
| 5 | 40.25 | 42 | 45 |
| 10 | 26.45 | 30.96 | 35 |
| 15 | 21.31 | 26.69 | 28.63 |
| 20 | 18.12 | 23.57 | 26.53 |
| 25 | 15.17 | 20.06 | 24.27 |
| 30 | 11.35 | 17.88 | 23.64 |
| 35 | 9.56 | 15.55 | 22.48 |
| 40 | 9.17 | 14.61 | 21.08 |
| 45 | 8.32 | 13.45 | 20.06 |
| 50 | 7.07 | 12.36 | 19.68 |
| 55 | 6.67 | 11.81 | 18.51 |
| 60 | 5.51 | 10.26 | 18.12 |
| 65 | 5.12 | 9.87 | 17.88 |
| 70 | 4.42 | 9.48 | 17.5 |
| 75 | 4.18 | 9.17 | 16.64 |
| 80 | 3.87 | 8.63 | 15.94 |

A comparison curve chart of gas extraction concentrations shown in FIG. 3 is generated according to the above table.

What is claimed is:

1. An enhanced gas extraction system based on dual-pulsation and acid fracturing permeability enhancement for a low-permeability coal seam, comprising an overpressure protection mechanism (9), a fracturing liquid delivery line (7) with a liquid delivery end extending into a fracturing borehole (2), a gas extraction line (8) with an extraction end extending into an observation borehole (3), a mixing tank (4) containing fracturing liquid, a pressure control and monitoring mechanism (5) for controlling a fracturing pressure and a frequency adjustment and monitoring mechanism (6) for adjusting a pulsation frequency, wherein the pressure control and monitoring mechanism (5) comprises a first branch (55) and a first pressure transmitter (51), a pressure data acquisition unit (52) and a first solenoid valve (53) which are connected in sequence along the first branch (55); the frequency adjustment and monitoring mechanism (6) comprises a second branch (64) and a third pressure transmitter (61), a second solenoid valve (62) and a frequency controller (63) which are connected in sequence along the second branch (64); when the third pressure transmitter (61) reaches a set pressure, a signal is transmitted, by means of the second solenoid valve (62), to the frequency controller (63) for comparison with a design frequency; a head end of the first branch (55) and a head end of the second branch (64) are both connected to the fracturing liquid delivery line (7), and a tail end of the first branch (55) and a tail end of the second branch (64) are both connected to a pulsation fracturing pump (71); the fracturing liquid delivery line (7) is connected to the mixing tank (4) and the fracturing borehole (2) and sequentially provided with the pulsation fracturing pump (71), a filter (72), a pressure gauge (73), a flowmeter (74), a throttling valve (75) and a liquid-injection line valve (76) in a delivery direction of the fracturing liquid; the gas extraction line (8) comprises a negative-pressure extraction tube (81) connected to an output end of the fracturing liquid delivery line (7) and the observation borehole (3), a fracturing borehole extraction valve (82) is arranged at a joint between the negative-pressure extraction tube (81) and the fracturing liquid delivery line (7), and an observation borehole extraction valve (83) is arranged at a joint between the negative-pressure extraction tube (81) and the observation borehole (3); the overpressure protection mechanism (9) comprises a third branch (93) connected to the fracturing liquid delivery line (7) and a second pressure transmitter (91) and a third solenoid valve (92) which are connected in sequence along the third branch (93); and when a pressure of the fracturing liquid delivery line (7) is higher than a set pressure, the third solenoid valve (92) is powered to be turned on to release the pressure for protection.

2. The enhanced gas extraction system based on dual-pulsation and acid fracturing permeability enhancement for a low-permeability coal seam according to claim 1, wherein high-pressure bushings are arranged on sections, connected to the fracturing liquid delivery line (7), of the first branch (55), the second branch (64) and the third branch (93), and a high-pressure hose is arranged at a joint between the gas extraction line (8) and the fracturing liquid delivery line (7).

3. The enhanced gas extraction system based on dual-pulsation and acid fracturing permeability enhancement for a low-permeability coal seam according to claim 1, wherein openings of the fracturing borehole (2) and the observation borehole (3) are sealed with high-pressure capsules, and a high-pressure sealing joint (21), corresponding to the liquid delivery end of the fracturing liquid delivery line (7), is arranged at the opening of the fracturing borehole (2).

4. An enhanced gas extraction method based on dual-pulsation and acid fracturing permeability enhancement for a low-permeability coal seam, comprising:

S1, carrying out detailed research on a target coal seam (1) to complete sampling, then performing proximate analysis, elemental analysis and mineral content determination on a coal sample, and obtaining, according to mineral-acid solution reaction kinetics, fracturing liquid most suitable for the target coal seam (1);

S2, drilling a fracturing borehole (2) and an observation borehole (3) spaced apart from and parallel to the fracturing borehole (2) in the target coal seam (1), and then mounting the enhanced gas extraction system based on dual-pulsation and acid fracturing permeability enhancement for a low-permeability coal seam according to claim 1;

S3, starting the pulsation fracturing pump (71) to fill the fracturing borehole (2) with prepared fracturing liquid by means of the fracturing liquid delivery line (7), controlling a fracturing pressure of the fracturing liquid to 4 Mpa-6 Mpa by means of the pressure control and monitoring mechanism (5) and adjusting a pulsation frequency of the fracturing liquid to 30 Hz-40 Hz by means of the frequency adjustment and monitoring mechanism (6), performing continuous and periodic fracturing on the fracturing borehole (2), and when water flows out from the observation borehole (3), stopping delivering the fracturing liquid into the fracturing borehole (2);

S4, starting again the pulsation fracturing pump (71) to fill the fracturing borehole (2) with the fracturing liquid, controlling the fracturing pressure of the fracturing liquid to 2 Mpa-3 Mpa by means of the pressure control and monitoring mechanism (5) and adjusting the pulsation frequency of the fracturing liquid to 15 Hz-20 Hz by means of the frequency adjustment and monitoring mechanism (6), performing continuous and periodical fracturing on the fracturing borehole (2), and when water flows out from the observation borehole (3), stopping delivering the fracturing liquid into the fracturing borehole (2); and S5, repeating S3-S4 five times, turning off the liquid-injection line valve (76), turning on the fracturing borehole extraction valve (82) and the observation borehole extraction valve (83), and periodically sampling and detecting gas concentrations in the fracturing borehole (2) and the observation borehole (3) at intervals to generate data.

5. The enhanced gas extraction method based on dual-pulsation and acid fracturing permeability enhancement for a low-permeability coal seam according to claim 4, wherein in S1, an acid solution formula range corresponding to contents of main minerals in the coal sample under different conditions is solved by means of an interface reaction model to obtain the fracturing liquid most suitable for the target coal seam, wherein the acid solution formula range is solved according to the following reaction rate expression:

$$J = KC_s^m$$

where, J is a reaction rate, mol/(cm$^2$·s); $C_s$ is an acid concentration of a rock surface at a reaction time t, mol/L; m is the number of reactions; K is a reaction rate constant, mol/[cm$^2$·s·(mol/mL)$^m$];

assume common logarithms are adopted at both sides of the formula, an acid-rock reaction kinetics calculation formula is determined:

$$lgJ = lgK + mlgC$$

lgJ and lgC are plotted, the reaction rate constant K and m are obtained by means of intercepts of straight lines, and then a reaction kinetics equation is obtained; according to the reaction kinetics equation, types and contents of fillings in the coal seam and properties of an acid solution, the acid solution formula range corresponding to the contents of the main different minerals in the coal sample is obtained;

a dissolving effect of acid fracturing liquid on the minerals in coal is based on a solid-liquid reaction, and acid solution formulas corresponding to the contents of the minerals in the coal sample under different conditions are solved by means of the following solid-liquid reaction kinetics model formula:

$$C = \frac{mt}{n + t}$$

where, C is a dissolution proportion, %; t is a reaction time, s; m is maximum dissolution of the acid solution on the minerals and reflects a dissolving capacity of the acid solution to the minerals, and n is a reaction time when half of the minerals are dissolved by the acid solution and reflects a dissolution rate of the acid solution to the minerals;

the contents of the minerals in the coal sample are quantitatively measured, and according to the acid solution formula range corresponding to the contents of the main different minerals in the coal sample, the optimal fracturing liquid is selected by comparing values of m and n in the kinetics equation for dissolving the minerals by the acid solution according to a selection criterion that the value of m is as great as possible and the value of n is as small as possible.

6. The enhanced gas extraction method based on dual-pulsation and acid fracturing permeability enhancement for a low-permeability coal seam according to claim 4, wherein in S2 and S3, when water flows out from the observation borehole (3), the fracturing liquid is stopped from being delivered into the fracturing borehole (2) for 30-45 min.

7. The enhanced gas extraction method based on dual-pulsation and acid fracturing permeability enhancement for a low-permeability coal seam according to claim 4, wherein the fracturing pressure and pulsation frequency in S3 are twice the fracturing pressure and pulsation frequency in S4.

* * * * *